US005749210A

United States Patent [19]

Kikuchi et al.

[11] Patent Number: 5,749,210

[45] Date of Patent: May 12, 1998

[54] CREEL WITH TWO-FOR-ONE TWISTING UNITS

[75] Inventors: Koichi Kikuchi; Tadashi Tukamoto, both of Shimada, Japan

[73] Assignee: Kikuchi Kogyo Co., Ltd., Shizuoka, Japan

[21] Appl. No.: 596,288

[22] PCT Filed: Mar. 17, 1995

[86] PCT No.: PCT/JP95/00496

§ 371 Date: Oct. 9, 1996

§ 102(e) Date: Oct. 9, 1996

[87] PCT Pub. No.: WO96/10664

PCT Pub. Date: Apr. 11, 1996

[30] Foreign Application Priority Data

Oct. 3, 1994 [JP] Japan ..... 6/239183

[51] Int. Cl.[6] ..... D01H 1/10

[52] U.S. Cl. ..... 57/58.49; 57/58.54; 57/58.55; 57/58.83; 57/352; 242/131; 242/131.1; 242/594.6

[58] Field of Search ..... 242/131, 131.1, 242/564.5, 594.6; 57/58.49, 58.52, 58.54, 58, 55, 58.7, 58.72, 58.83, 352

[56] References Cited

U.S. PATENT DOCUMENTS 4,332,129 6/1982 Schipper et al. ..... 57/105

4,789,008 12/1988 Kikuchi ..... 139/97

FOREIGN PATENT DOCUMENTS 58-149353 9/1983 Japan .

62-53451 3/1987 Japan .

*Primary Examiner*—William Stryjewski

*Attorney, Agent, or Firm*—Neal L. Slifkin

[57] ABSTRACT

A creel 1 with twisting devices is capable of directly supplying twisted yarns from bobbins carrying non-twisted yarns to a loom or a warper, and of producing not only normal fabric but also a fabric having a low weft density woven at a higher rate or a fabric using hard-twist yarns as warps. A plurality of rotatable spindles 8, each carrying a bobbin 3 on which a non-twisted yarn 2 is wound, are arranged on a frame 18. The yarns 2 withdrawn from the bobbins 3 on the spindles 8 are twisted and arranged to form a yarn sheet 19. The spindles 8 are rotatably secured via bearings to the frame 18 of the creel 1 at the center of a rotary shaft section 8' which is arranged in a horizontal direction. On both ends of the rotary shaft section 8', a section for supporting the bobbin 3 carrying the non-twisted yarn 2 is formed, on which a two-for-one twisting device 21 is provided.

10 Claims, 10 Drawing Sheets

CREEL WITH TWO-FOR-ONE TWISTING UNITS

TECHNICAL FIELD

The present invention relates to a creel for supplying yarns directly to an apparatus for collectively processing the yarns, such as a loom or a warper, or to a yarn winding apparatus such as a bobbin winder, while twisting non-twisted yarns in a single twisting manner or in a two-for-one-twisting manner.

BACKGROUND ART

In the conventional art, when a belt-like fabric such as a safety belt or a sling belt is woven by using twisted yarns as warp, a beam formed by a predetermined number of twisted yarns wound thereon is loaded on a loom, or a creel carrying a plurality of bobbins of twisted yarns is used, from which the twisted yarns are fed to the loom.

When the twisted yarns are used as warp, the following problems may occur.

It is a custom that the twisting operation itself is generally not carried out by a fabric maker but is done by outside twisters. Therefore, although it is necessary to change a twisting degree in accordance with the required feelings of the individual fabrics so that the nature of a yarn is modified to be suitable for the use of a fabric, the change of twisting degree is substantially impossible after the yarn has been twisted even if it is found to be unsuitable, and the twisted yarns must be used as they are. Moreover, a length of yarn wound on a bobbin may vary from one bobbin to another resulting in a considerable amount of wasted twisted yarn.

Further, since a length of twisted yarn wound on a bobbin is at most one half, usually one third, of a length of large-packaged raw yarn, it is necessary to change the exhausted bobbin of twisted yarn for a new one and tie the two together. This results in not only a troublesome manual operation but also an increase in waste because the tied portion of yarn cannot be used for producing a fabric for certain uses and must be scrapped. As described above, there are many inconveniences in the process for the production of a woven fabric wherein twisted yarns are used as warp, compared with another process wherein non-twisted yarns are supplied directly to a loom from a creel as described below.

That is, the process wherein non-twisted yarns are directly supplied as warp from the creel is more advantageous from the viewpoint of production efficiency compared with the former process, for the following reasons. Since large-packaged raw yarns are used, it is unnecessary to tie the raw yarns together during the weaving operation; a rewinding process and warping process are eliminated; and it is unnecessary to rely on an outside twisted yarn maker for the twisting operation of raw yarn. However, there are problems in the process in that the quality of the resultant product is relatively inferior. For example, the resultant product has a feeling limited to a softer range and has a lower wear resistance because the non-twisted yarn is used, and the production process becomes troublesome when a certain type of yarn is used due to the generation of a large amount of fluff during the weaving operation due to filament breakage, whereby, in a worst case, it is necessary to stop the loom and restore the loom to a normal state.

To solve the above problems, the present inventors proposed, in Japanese Patent Application No. 57-029084, a creel provided with a plurality of twisting devices of a flyer type on bobbins, each carrying an non-twisted yarn, so that the non-twisted yarn is twisted while being supplied from the bobbin. Although the purpose for supplying a large-packaged non-twisted yarn while twisting the same to a loom has been attained according to this invention, it has been found that the installation cost becomes large.

Next, the present inventors proposed in Japanese Patent Application No. 60-189847, to achieve the same object with a relatively small installation cost, a creel using a ring-traveller type twisting device, which is simpler in structure and relatively inexpensive compared with the aforesaid flyer type twisting device.

However, the installation cost thus lowered was still expensive relatively to the twisting cost. Accordingly, the problem remains basically unsolved.

In either of the above two prior arts, a combination of a shaft and bevel gear is disclosed, used as means for driving a spindle which is a main part of the twisting device. However, this combination entails a complicated mechanism and hinders reduction of installation cost.

In Japanese Patent Publication No. 60-189847, techniques for supplying two-directionally twisted yarns, S-twisted yarns and Z-twisted yarn, are disclosed. However, such techniques are limited to a method for changing the rotational direction while using a single motor by changing the application mode of a belt and another method wherein two driving systems are used, and there is no disclosure wherein the rotational speed, i.e., the twisting degree, is changed at a plurality of levels.

In addition, there is no disclosure in the above two prior arts of a case wherein a tapered paper tube or an aluminum pirn is used and a yarn is withdrawn only in one direction therefrom, but solely a so-called straight paper tube (cylindrical paper tube) is used for carrying a raw yarn. There has been a demand for a creel provided with twisting devices capable of handling raw yarns of the above-mentioned package types.

In the above two prior arts, it is thought that the rotational speed of a spindle is set to a relatively low level (300 rpm as a standard), because the twisting degree of the twisted yarn used for producing fabrics is 100 turn/m for 1,000 denier yarn or 80 turn/m for 1,500 denier yarn.

Therefore, there may be no problem even though a simple mechanism is used for rotating a spindle on which a bobbin is fixedly held. However, when such a creel is adopted to weave a fabric having a low weft density such as a cord fabric, substantially no twist is imparted to the yarn because the rotational speed is too low to obtain sufficient twisting. In addition, this creel cannot be used when highly twisted yarns are desired as warps of fabric.

DISCLOSURE OF THE INVENTION

It is an object of the present invention to eliminate the above-mentioned drawbacks of the prior art and provide a creel with twisting devices capable of handling various type bobbins on which a non-twisted yarn to be processed is wound and suitably used for producing not only usual knit/woven fabrics and nets but also fabrics to be woven at a higher rate because of their low weft density such as a cord fabric and those wherein highly twisted yarns are used as warp, the creel being able to be manufactured at an extremely low cost and exclusively used as a twisting apparatus wherein yarns are merely twisted and wound.

To achieve the above object, a creel is provided according to the present invention, comprising a plurality of spindles rotatably held on a frame, each carrying bobbins on which non-twisted yarns are wound, whereby the non-twisted yarns withdrawn from the bobbins are twisted and the thus-twisted yarns are arranged in parallel to each other to form a yarn sheet, wherein each of the spindles has a horizontal rotary shaft section which is rotatably secured at a center thereof to the creel frame via bearings, and a bobbin carrying section provided on both end portions of the rotary shaft for carrying the bobbin on which the non-twisted yarn is wound; a suitable driving means is provided and engaged with the rotary shaft section; and a single twisting operation or a two-for-one twisting operation is provided on the bobbin carrying section.

Although in the following explanation, a creel used for giving yarns a two-for-one twist, is mainly referred, the present invention is not restricted to this embodiment.

The creel according to the present invention, and having the two-for-one twisting mechanism or the normal one is operated as follows:

Various inconveniences reside in the prior art creel with twisting devices, because bobbins must be rotated; for example, it is necessary to orient the bobbin so that the yarn is unwound in reverse to the rotational direction (if the bobbin is a straight paper tube, its carrying direction must be considered), or if the yarn withdrawal is limited to only one direction, it is necessary to preliminarily prepare the bobbin so that the unwinding direction is reversed (for example, in the case of tapered paper tube). According to the twisting device of the present invention, however, since a bobbin is stationary by the use of a two-for-one twisting mechanism and the yarn unwinding direction is irrelevant to the bobbin rotational direction, there is an advantage in that any kind of bobbin may be used while maintaining the proper positions, regardless of whether the twisting direction is S or Z.

Further, the spindle driving means comprises a single common motor and a driving system for transmitting power from the motor to the rotary shaft section of the respective spindle via a suitable power transmission means such as belts or chains. Such a driving system may be single or plural. If the respective system is adapted to be able to optionally vary the rotational speed and direction of a group of spindles, it is possible to readily change the twisting degree and/or the twisting direction in each of the driving systems, if necessary, in accordance with the yarn qualities and/or yarn thicknesses.

BEST MODES FOR CARRYING OUT THE INVENTION

The present invention will be described below in more detail with reference to the drawings illustrating the preferred embodiments.

Figure 1:
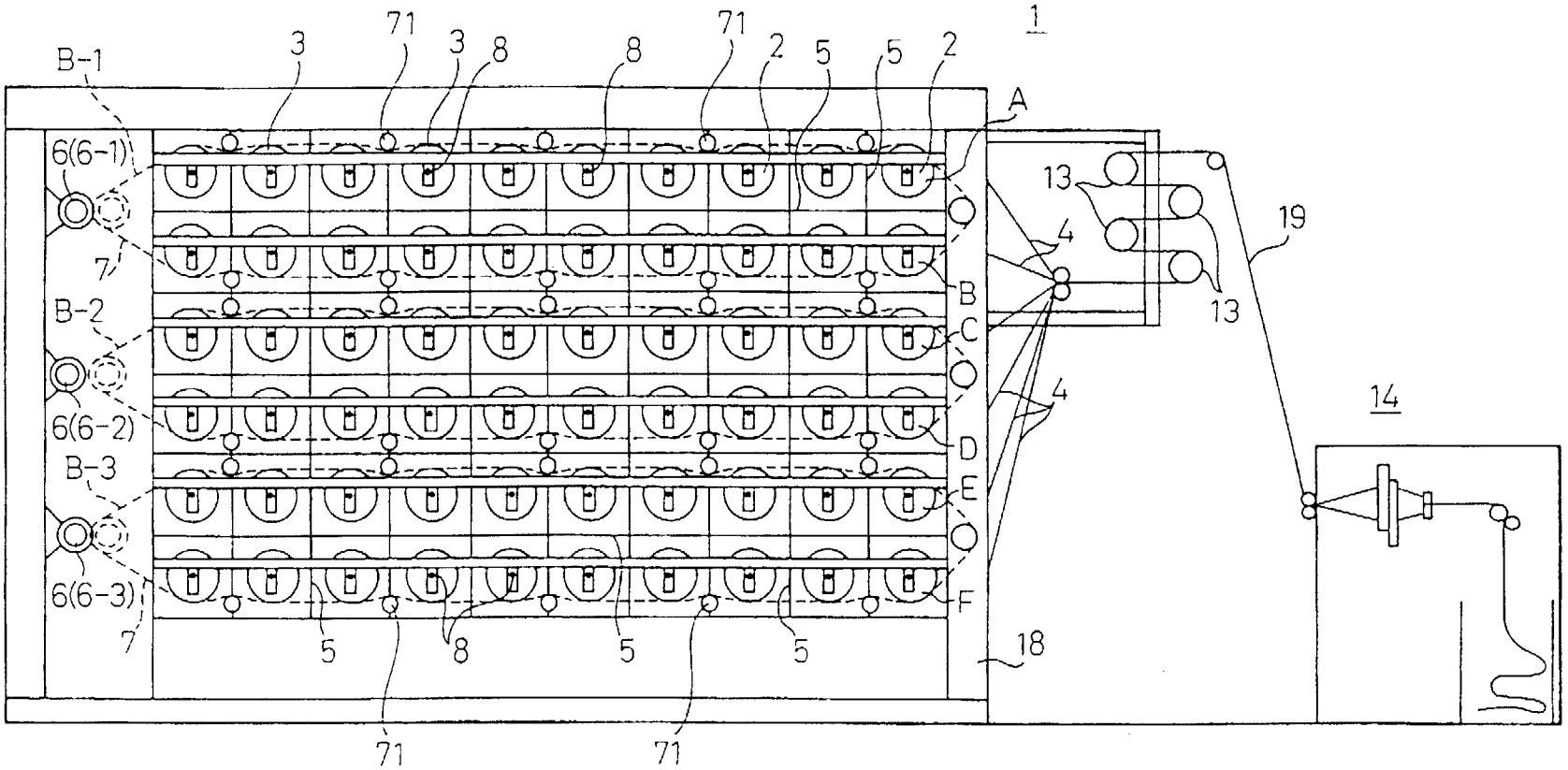
FIG. 1 is a side view of one embodiment of a creel with two-for-one twisting devices according to the present invention.
Figure 2:
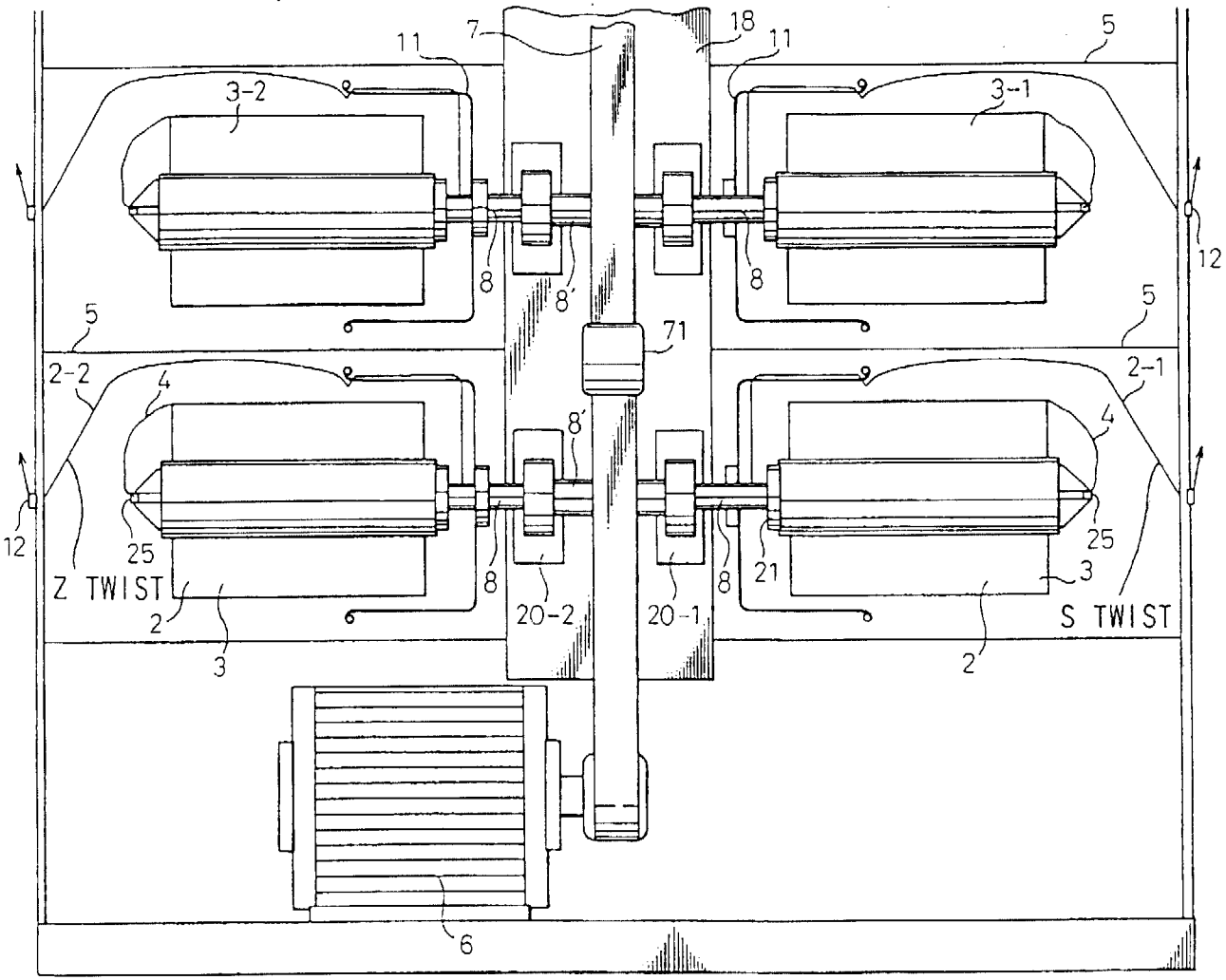
FIG. 2 is a plane view of the creel shown in FIG. 1, illustrating a spindle driving system and two-for-one twisting devices in a partially enlarged manner.

FIG. 1 is a side view of one embodiment of a creel with two-for-one twisting devices according to the present invention, and FIG. 2 is a plane view of the creel shown in FIG. 1 in a partially enlarged manner.

FIGS. 1 and 2 illustrate a creel 1, in which a plurality of spindles 8 are arranged on a frame 18. The respective spindle 8 carries a bobbin 3 on which a non-twisted yarn 2 is wound, and is rotated by a suitable driving means 7 including a belt or the like. Yarns 4 withdrawn from the bobbins 3 are twisted while being withdrawn, and the thus-twisted yarn are arranged in parallel to each other to form a yarn sheet 19. The respective spindle 8 includes a horizontal rotary shaft 8' rotatably held at a center thereof on the frame 18 of the creel 1 via bearings 20-1, 20-2. A spindle section is provided in at both ends of the rotary shaft 8' for carrying the bobbin 3 on which the non-twisted yarn 2 is wound. In addition, a two-for-one twisting device 21 is provided at a portion on which the bobbins 3 are mounted.

In the present invention, the rotary shaft 8' is driven to rotate in the desired direction by a driving means such as a belt, toothed belt, chain or gear train; or a motor directly coupled to the rotary shaft 8' via a suitable coupling means.

Figure 3:
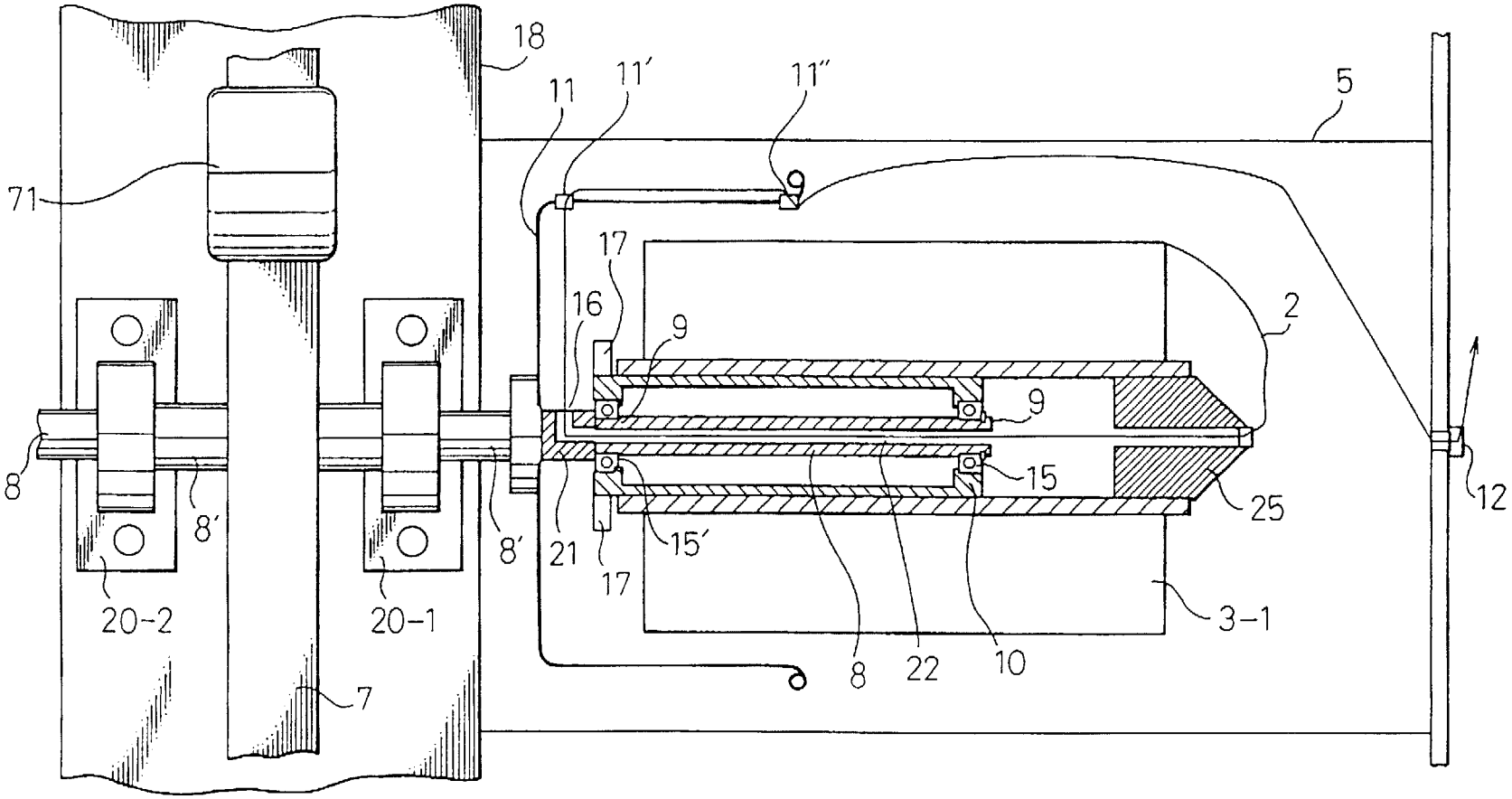
FIG. 3 is an enlarged illustration of the twisting device shown in the plane view of FIG. 2.
Figure 4A:
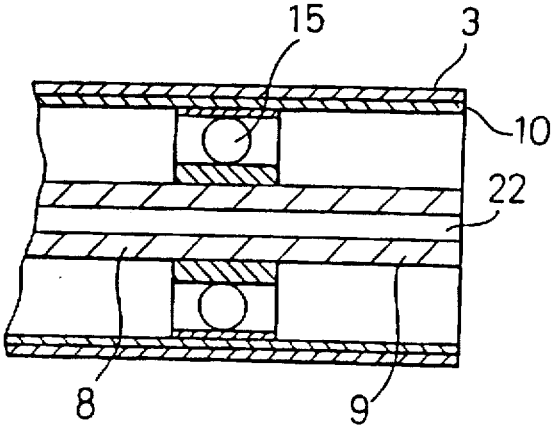
FIG. 4 is a partial cross section of FIG. 3.
Figure 4B:
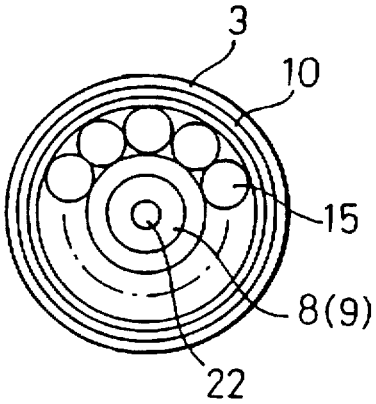

As apparent from FIG. 2 and FIG. 3 which is a partial enlargement of FIG. 2, and FIG. 4 which is a partial cross section thereof, the creel 1 with the two-for-one twisting devices 21 according to the present invention preferably has a hollow shaft 22 along an axis of the spindle 8, on which the bobbin 3 of the non-twisted yarn is to be carried. Also, a driving means 7 for rotating the spindle 8 in one direction is provided. If the driving means 7 operates, the non-twisted yarn 2-1 withdrawn from the bobbin 3-1 located on one side (A) of the frame 18 of the creel 1 is double-twisted in one of the S- and Z-directions, while the non-twisted yarn 2-2 withdrawn from the bobbin 3-2 located on the other side (B) is double-twisted in the other of the Z- and S-directions.

The driving means 7 is coupled to a suitable power source 6 such as a common motor and engaged with the rotary shafts 8' of a plurality of spindles to rotate each of the spindles in an optional direction, respectively.

In FIG. 1, the driving means 7 connected to one motor 6-1 is adapted to be engaged with a plurality of the rotary shafts 8' each forming a group among all of spindles arranged on the creel 1, and arranged in two adjacently arranged rows. Thus three driving systems are provided in this creel 1, each one of the driving systems comprising the above-mentioned mechanism.

The creel 1 with two-for-one twisting devices 21 will be explained next in more detail. As shown in FIG. 3, the spindle 8 having a hollow shaft 22 is rotatably provided within a bobbin support 10 for carrying the bobbin 3 stationarily on which the non-twisted yarn 2 is wound. A two-for-one twisting device 21 for withdrawing the yarn from a base of the spindle 8 or a rear end of the bobbin 3 and for double-twisting the same is provided on the spindle 8 and the driving means 7 for driving the spindle 8 is also provided. Thus, the non-twisted yarn 2 is withdrawn from the bobbin 3 and double-twisted while being supplied to a predetermined apparatus 14 such as a loom, knitting machine, or warping machine. The spindle 8 has a rotary shaft 8' forming a center portion thereof and held by at least two bearings 20-1, 20-2 and having a hollow spindle section 9 comprising a hollow shaft portion 22 provided at both ends of the rotary shaft 8'. A plurality of the spindles 8 are arranged in a horizontal position on the creel to form a group as seen from the lateral side of creel, and a plurality of such spindle groups are provided in a multi-layered configuration. All the spindles 8 may be driven as one group by a single driving means 7 in a predetermined direction. Alternatively, the spindles 8 may be divided into several subgroups, each having an individual driving means 7, so that each subgroup is driven in a predetermined direction independently from the other groups. In the latter case, it is possible to rotate two non-twisted yarns held on one spindle 8 in different directions from each other so that an S-twist is imparted to one yarn and a Z-twist to the other at the same time.

In the creel 1 with the two-for-one twisting devices 21 according to the present invention, there is an eyelet 25 directly at a free end of the hollow shaft 22 of the respective spindle 8 or at a distance therefrom, for guiding the non-twisted yarn 2 withdrawn from the bobbin 3 to the hollow shaft 22, and a guide eyelet 16 in the vicinity of the base of hollow shaft 22 or the rear end of the bobbin, for withdrawing the yarn from the hollow shaft 22. Also a pot-shaped outlet guide 11 extends from the guide eyelet 16 while encircling the rear end of the bobbin, and an outlet eyelet 12 is provided at a position directly opposite from the free end of the spindle 8 along the extension line of the hollow shaft 22.

Yarn guides 11' and 11" may be provided on the pot-shaped outlet guide 11.

Preferably, in the creel with two-for-one twisting devices according to the present invention, a bobbin support 10 is provided on an outer periphery portion 9 of the spindle 8 having the hollow shaft 22 through bearings 15, 15' for holding the bobbin 3 on which the non-twisted yarn 2 is wound. Also rotation-inhibiting means 17 is provided on the bobbin support 10, for keeping the bobbin support 10 stationary while the spindle 8 is rotating.

The rotation-inhibiting means 17 may be a dead weight of suitable mass or a magnet so as to prevent the bobbin support 10 from being rotated.

The bobbin support 10 and the hollow shaft section used in the present invention can be replaced by another type of the support in accordance with the shapes and types of the bobbin on which the non-twisted yarn is wound.

Preferably, the rotational speed of spindle 8 used in the present invention is variable in a range between 0 and 3,600 rpm by the driving means 7 such as a driving belt, and the driving device 7 is coupled to a power source such as a motor 6 to be rotatable in an optional direction at an optional speed.

In the present invention, a single driving system comprising the power source such as motor 6 and the driving means 7 may be arranged to consist of a driving mechanism of the present invention, or a plurality of the driving systems may consist of the driving mechanisms of the present invention whereby the rotational direction and speed of the spindles belonging to the respective systems are preferably variable.

The apparatus 14, to which twisted yarns are supplied from the creel 1 with two-for-one twisting devices, is one in which the twisted yarns are collectively processed, such as a loom or a knitting machine, or in which the twisted yarns are collectively taken up, such as a warper.

In short, the creel 1 with two-for-one twisting devices 21 according to the present invention has a structure in that a rotatable hollow spindle 8 and a two-for-one twisting device 21 are provided in a bobbin support 10 for supporting a bobbin 3 stationarily on which a non-twisted yarn 2 is wound, so that the yarn 2 is withdrawn from the base of the spindle 8 or the rear end or intermediate portion of the bobbin 3 and supplied, while being twisted, to a predetermined apparatus 14. As seen in a plane view shown in FIGS. 2 and 3, in a central area of the creel 1, the spindle 8 has a rotary shaft section 8' held by at least two bearings, and two hollow shaft sections 22 at both ends of the rotary shaft section 8'. Therefor the hollow sections forming a single rotary body with the rotary shaft section 8'. The spindles 8 are arranged in parallel in the horizontal direction as seen from a side portion of the creel 1. A plurality of such parallel arrangements are provided in the vertical direction in a multi-layered configuration as seen from a side portion of the creel. The spindles 8 are rotated by motors 6 and driving means 7 in one predetermined direction at a variable speed so that an S-twist and a Z-twist are separately and simultaneously applied to the respective yarn withdrawing from each bobbins 3 provided on the two spindle sections 8 formed on one rotary shaft 8'. The power source 6 and the driving means 7 form a single driving system or a plurality of driving systems wherein each driving system is adapted to vary the rotational direction and speed of the spindle belonging thereto. The creel 1 according to the present invention is constructed by the above-mentioned novel technology and can be used when a very large amount of twist to be applied to the yarn in a unit time is required.

The creel structure according to the present invention will be described in more detail with reference to FIGS. 1 and 2. FIG. 1 is a side view of the creel 1 and FIG. 2 is a plane view of the creel 1.

As apparent from FIGS. 1 and 2, a plurality of groups of spindles 8 are arranged on a frame 18 of the creel 1, and each two adjacent spindle groups arranged horizontally form each one block B1, B2 and B3. In each one of the blocks, a single common motor 6 is provided and drives all the spindles 8 belonging to each block in the same direction, via a driving means 7 such as a belt or a chain engaged in the center portion of the respective spindle.

In this embodiment, especially when the belt is used as the driving means 7, it is preferable to provide tension pulleys 71 at a predetermined pitch so that the belt 7 always engages with the center portion 8' of the spindle under a predetermined pressure.

Preferably, the driving motor 6 provided in each block moves to a position shown by dotted lines when the belt 7 is set on each one of the spindles 8, and returns to a position shown by solid lines to impart a predetermined tension to the belt after the belt has been set.

As shown in FIG. 2 which is a plane view of the creel, the spindle 8 has at least two bearings 20-1 and 20-2 in a center section and, as shown in FIG. 3 which is a partially enlarged view of FIG. 2, a hollow shaft section 22 forming a hollow yarn path at both ends of the center section. Also a guide eyelet 16 and an outlet guide 11 are provided for withdrawing the yarn from a base of the hollow shaft section 22.

Of course, the hollow path may be provided throughout the spindle shaft. In such a case, the guide eyelet 16 may be provided at a proper position in the middle of hollow path.

There is a bobbin support 10 on outer peripheral portion of the hollow spindle 9 through a bearing, whereby a bobbin 3 on which a non-twisted yarn 2 is wound, is held.

In this structure, the bobbin support 10 is made stationary by a weight 17 even though the spindle 8 is driven to rotate, so that the bobbin 3 carrying the non-twisted yarn 2 is stationary when the creel is in operation.

The hollow spindle 9 and bobbin support 10 preferably form a module adapted to be attachable and detachable relative to the rotary shaft section 8' forming a center portion of the spindle, so that the module is replaceable, if necessary, in accordance with the shape of raw yarn packages.

The replaceable module is not a basic and indispensable constituent feature, but is only one aspect of the present invention. That is, the module may be of a fixed type.

In the structure shown in FIG. 2, the spindle 8 is, of course, rotated in one direction. This means that, when seen in the withdrawing direction, the non-twisted yarn 2 on the right-hand side (A) in FIG. 2 rotates clockwise and that on the left-hand side (B) rotates counterclockwise.

Accordingly, on the right-hand side (A) in FIG. 2, the non-twisted yarn 2 drawn into the hollow shaft section 22 is imparted with a first S-twist by the rotation of the base of the hollow shaft section, and then with a second S-twist between the outlet guide 11 and the outlet eyelet 12.

While, on the left-hand side (B), the non-twisted yarn 2 is imparted with two Z-twists while the spindle is once rotated in the same twisting mechanism as mentioned-above, because the rotational direction thereof is counterclockwise.

Therefore, if the rotational direction of the spindle 8 is reversed, a Z-twist is imparted on the right-hand side (A), and an S-twist is imparted on the left-hand side (B).

That is, as far as the same driving means is used, the twisting direction applied to the yarn withdrawn from a bobbin provided on one end of the spindle 8 is always opposite to that of the yarn withdrawn from a bobbin provided on another end of the spindle but the rotational speed, i.e., the twisting degree, is identical to each other.

A more detailed explanation of the structure and operation of the creel according to the present invention will be given below with reference to the drawings.

In FIG. 1, a predetermined number (60 pcs. on one side visible in FIG. 1 and 60 pcs. on the opposite side; total 120 pcs.) of bobbins 3, each carrying the non-twisted yarn 2, are arranged in the creel. The non-twisted yarn 2 is withdrawn from each bobbin 3 and twisted in a path to each outlet eyelet 12. A group of the thus-twisted yarns 4 are supplied to the above mentioned predetermined apparatus 14 (for example, a narrow width needle loom shown in FIG. 1) via tension rollers 13 while maintaining a parallel arrangement.

Elements arranged in a lattice manner in FIG. 1 comprise an anti-ballooning member 5 which is effective for preventing contact of a balloon of the yarn twisted on one spindle with that of a yarn twisted on an adjacent spindle. Note that the member 5 is made of a woven or knit fabric, film, nonwoven fabric, plate or rod.

If the apparatus 14 is a warper, warping speed should be at a lower level when a creel with conventional twisting devices is used. Contrary to this, according to the present invention, the warping operation can be favorably carried out at a higher speed than the conventional speed.

FIG. 3 illustrates one embodiment of the creel 1 with two-for-one twisting devices 21 according to the present invention, wherein if the apparatus 14 (a loom or a warper) starts to operate, the spindles 8 of the creel 1 also start to rotate in synchronism therewith. When the yarns run as the apparatus 14 is operated, the non-twisted yarn 2 is withdrawn from the stationary bobbin 3 and drawn into the yarn path 22 provided in the interior of the hollow spindle section 8 provided on both ends of the spindle 8' via the eyelet 25.

At this time, to simply prevent the yarn unwound from the bobbin 3 from falling down and interfering with a balloon of non-twisted yarn in the adjacent spindle 8 being imparted with a second twist, the raw yarn is preferably covered with a net or an envelope.

The non-twisted yarn 2 is imparted with a first twist between the base of spindle and the guide eyelet 16, and with a second twist between the guide eyelet 16 and the outlet eyelet 12.

The illustrated guide eyelet 16, outlet guide 11, eyelet 25 or the like is a mere example and can have any other shapes and structures. This is also true of the hollow spindle unit.

As described before, according to the present invention, an anti-ballooning member 5 is preferably provided between all adjacent spindles 8 so as to prevent a balloon of non-twisted yarn 2 during the second twisting from extending and interfering with the yarn of the adjacent spindle 8. An anti-ballooning plate 5 may be replaced by another member having a cylindrical form or others, provided the above function is obtainable.

Differences between the two-for-one twisting device used in the creel 1 according to the present invention and a so-called double twister of the conventional type are as follows.

(1) A pair of twisting units, which are provided on both ends of a single spindle positioned in the horizontal direction, are simple in structure and rotated at the same time. Thereby there is an advantage in that the installation cost per spindle is reduced.

(2) A guide eyelet 16 and an outlet guide 11 are provided on both ends of a center shaft portion. A unit consisting of a hollow spindle 9, outer bearings 15 and a bobbin support 10 is mounted to this area. The unit is replaceable if necessary.

(3) A precise tension adjustment, as in a case of a twister, is unnecessary because twisted yarns withdrawn from the creel 1 and supplied to an apparatus (a loom or a warper) generally pass a tension roller device so that a length and tension of warp are uniform. If such an adjustment is required, a tenser unit may be provided at a top end of bobbin.

(4) Since the rotational speed may be changed in a wider range, the application field is widened.

(5) Since the spindles are closely arranged in relation to each other so as to be installed, it is possible to prevent interference between ballooning yarns with a simple and lower cost structure.

With the creel of the present invention, twisted yarns are supplied to the above-mentioned apparatus (a loom or a warper). A twisting number necessary for the twisted yarn is determined by a rotational speed of the spindle and a running speed of non-twisted yarn withdrawn from a bobbin.

The withdrawing speed of non-twisted yarn relies on a take-up speed of the above-mentioned apparatus (a loom or a warper). For example, if a cord fabric is woven by a narrow width needle loom at a rotational speed of 2,400 rpm and a weft density of 3 cm/pick, a production rate is 72 m/min.

If it is necessary to impart a twist of 100 turn/m to warps, a rotational speed of the spindle is about 7,200 rpm in the conventional twisting device and about 3,600 rpm in the two-for-one twisting device.

If a warping operation is carried out at the same rotational spindle speed while imparting a twist of 100 turn/m to the yarn, a take-up speed of 72 m/min is obtained.

Since the take-up speed of the above-mentioned apparatus (a loom or a warper) is not constant and the twisting degree must be varied in accordance with materials and/or thicknesses of yarns, it is necessary that the spindle be rotatable in an optional direction at an optional speed in the present invention.

The yarn wound on the bobbin may be not only a non-twisted yarn but also a soft twist yarn available from a fiber maker (which is included as a non-twisted yarn in the present invention). Thickness of the non-twisted yarn is also optionally selected in accordance with the uses thereof. If necessary, raw yarns are plied with each other so that a ply-twisted yarn is obtained.

In the present invention, generally, all of the twisted yarns 4 withdrawn from the creel have the same twisting degree but one half thereof are twisted in an S-direction while a latter half in a Z-direction. If a plurality of spindle driving systems are provided, it is possible to partially change the twisting degree if necessary or vary an allocation of S-twist and Z-twist.

A driving device 7 for spindle 8 will be described with reference to FIG. 2. A number of spindles 8 not illustrated are rotated by a motor 6 and the driving device 7. In FIG. 1, a group of ten spindles 8 are arranged in one horizontal plane as seen from a side portion of the creel and six groups of spindles 8 are arranged in a multi-layered configuration in the vertical direction wherein three motors 6-1–6-3 are provided so that one motor drives two groups of spindles arranged horizontally. Alternatively the spindles may be driven by a single motor and driving means in one predetermined direction while varying the rotational speed thereof. Also, the position of motor may be above or beneath the creel. If it is desired to use S-twist yarns or Z-twist yarns in a predetermined width zone of fabric, it is preferable to locate the motor in a rear area of the creel, as shown in FIG. 1. To control spindle rotation, an AC motor of general purpose type is used and the rotational speed is changed by modifying a pulse width of a power voltage with an inverter via a control panel. The frequency can be modified in a range between 0 Hertz and 120 Hertz, which is considered in this case to theoretically correspond to a rotational motor speed in a range between 0 rpm and 3,600 rpm. To effectively convert the rotational speed throughout a wider range, when the higher rotational speed is mainly used, the motor is preferably coupled directly to the driving means; and when the lower rotational speed is mainly used, the motor is preferably coupled via a speed changer which can vary the speed continuously or in steps (for example, steps of one fifteenth).

If necessary, it is possible to adapt the driving system to be able to switch between the higher speed range and the lower speed range.

Alternatively, it is possible to adopt a variable speed motor so that the rotational speed is controllable.

Since the selection of motor, driving means and/or speed changer is well-known in the prior art, a detailed explanation thereof will not be given here. By adopting such a structure, the rotational speed of a spindle is variable over a wider range, for example, between 0 rpm and about 3,600 rpm, whereby the twisting degree can be easily changed and the creel can be used in more applications. In addition, if the spindles are not driven and remain stationary, it is possible to withdraw the non-twisted yarns as they are and supply the same to the above-mentioned apparatus.

In FIG. 1, two horizontal groups of spindles are driven by one motor system. However, if a plurality of driving means are provided in a multilayered configuration, it is possible to drive more spindle groups with one motor system. A pitch between the adjacent spindles is generally defined by a bobbin and an amount of raw yarn wound thereon.

In the above embodiment, while a plurality of spindle groups arranged in the horizontal direction on the creel are driven by a driving system consisting of one motor provided at one end of the frame 18 and belts or chains positioned in the horizontal direction, it is also possible to drive spindle groups by a driving means 7 consisting of a driving system including one motor provided at one end of the frame 18 and belts or chains positioned in the vertical direction.

The object of the present invention can be achieved according to the above embodiment. However, there is a problem in that slippage occurs when belts are used as a driving means even though the tension thereof is controlled as far as possible, which causes a high energy loss and lowers the driving efficiency. Therefore, this mechanism is unsuitable for a high speed drive. Also there is another problem when chains are used as a driving means in that the weight thereof is so heavy that the energy loss is significant and noise is generated when driven at high speed. Therefore, this mechanism has also been found to be unsuitable for a high speed drive.

To solve such problems, the present inventors have found that it is effective to directly provide the above driving means 7 for each spindle 8, so that the driving means 7 is formed by a motor 6 directly coupled to each one of the spindles 8, at a central rotary shaft section 8'.

Figure 5:
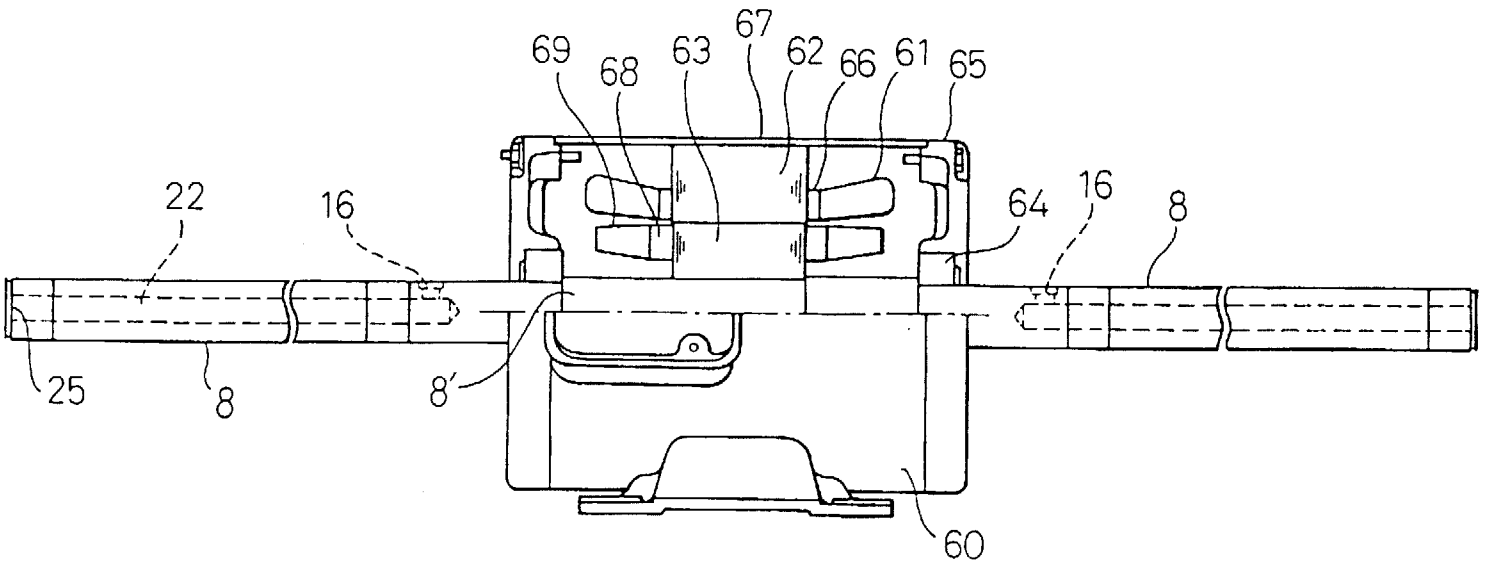
FIG. 5 is a partially sectioned plan view of a motor integral with a rotary shaft of spindle used for the present invention.

That is, in this embodiment, as shown in FIG. 5, the driving means 7 is a motor 60, the output shaft of which constitutes a rotary shaft section 8' of the spindle 8.

More specifically, the driving means 7 is structured by the motor 60 directly coupled to a central rotary shaft section 8' of each spindle 8. Motors 60 form one or more driving systems which are adapted to be capable of changing the rotational direction and speed of the spindles belonging to one driving system, independently from the other driving systems.

The motor 60 in this embodiment is formed from a stator 62 with a stator coil 61 and a rotor 63 with a rotor core constituted by laminated magnetic steel sheets. The rotary shaft section 8' of the spindle 8 is inserted into a center portion of the rotor 63.

In FIG. 5, the motor 60 is a three-phase squirrel cage type induction motor having a cage-shaped rotor 63, wherein reference numeral 64 denotes a bearing; 65 a bracket; 66 a stator coil insulator; 67 a frame; 68 a rotor end ring; and 69 an internal fan.

In this embodiment, the motor 60 of the above structure is mounted on each spindle 8, so that the spindle 8 can start, stop or rotate in a predetermined direction and at a predetermined speed.

Specifically, a control device including an inverter may be provided in the motor 60 of the respective spindle so that the rotational control is possible based on the frequency control by changing the pulse width.

In such a case, it is possible to rotate or stop the respective spindle or a group of spindles selected in accordance with a change in the number of yarns.

Also, by using frequency control, it is possible to easily carry out a soft-starting and/or a soft-stopping as well as an emergency machine stop or a modification of the rotation.

Since it is possible to synchronize the rotation of a plurality of motors 60 by using motors with the above structure, the rotational speeds of the respective spindles can be easily synchronized.

While the motors 60 provided for the respective spindles are individually controlled in the above embodiment, it is also possible to simultaneously control the motors 60 included in a group having a proper number of spindles, by a suitable control device in a manner similar to that described above.

In this case, it is preferable to form a group of about twenty motors 60 taking cost effectiveness into consideration.

Figure 6C:
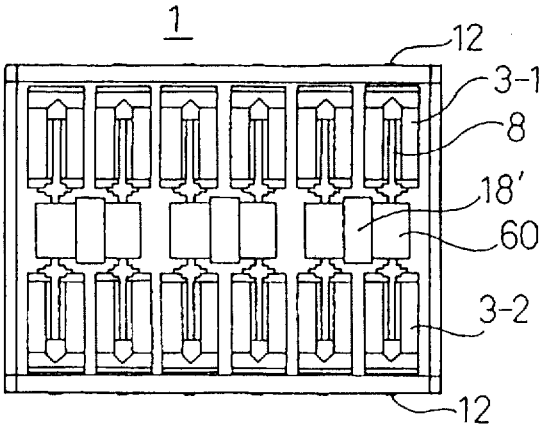
FIGS. 6(A) to 6(C) are a side view, a front view and a plane view, of the creel with two-for-one twisting devices according to the present invention, respectively, wherein the motor shown in FIG. 5 is arranged on the respective spindle.
Figure 6A:
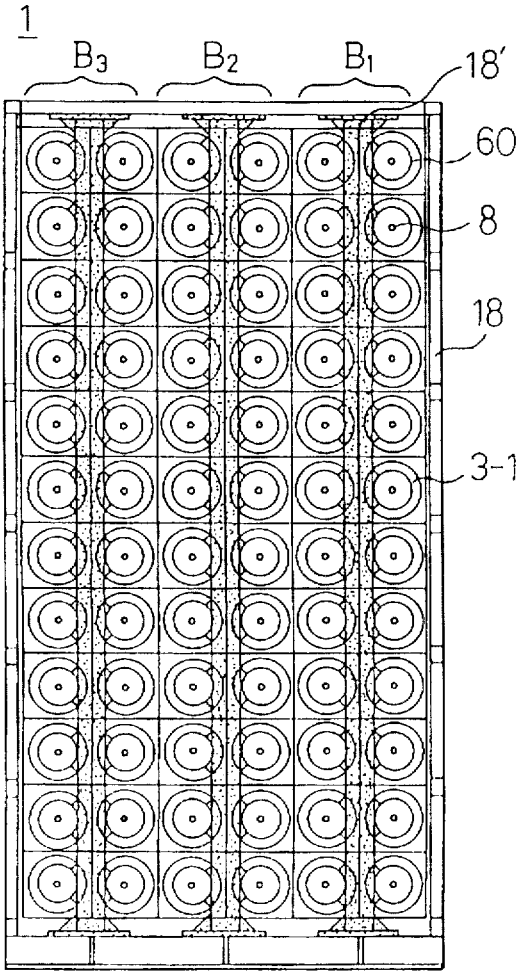
Figure 6B:
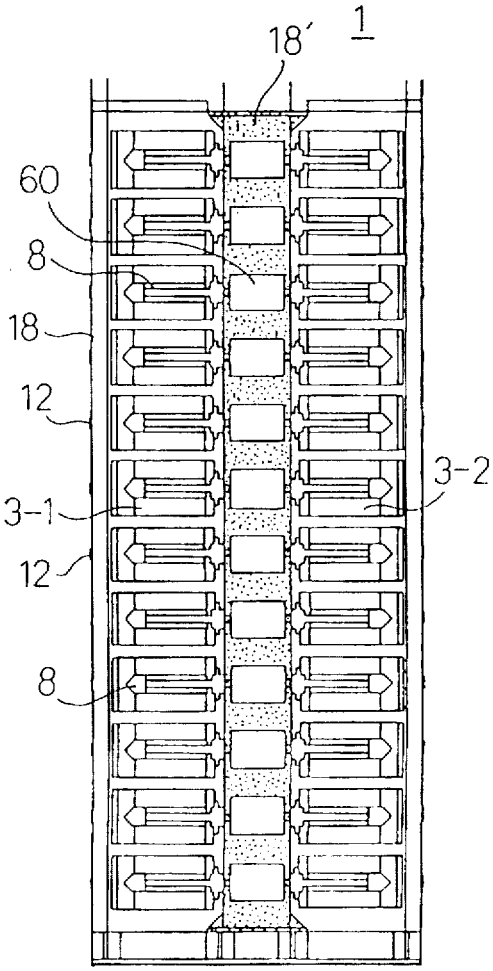

An arrangement of spindles 8 when the motors 60 are used in the creel 1 according to the present invention is shown in FIGS. 6(A) through 6(C) in comparison with the arrangement shown in FIGS. 1 and 2.

FIG. 6(A) is a front view of the creel 1; FIG. 6(B) is a side view thereof; and FIG. 6(C) is a plane view thereof.

As apparent from FIGS. 6(A) through 6(C), a plurality of groups of spindles 8 are arranged on a frame 18 of the creel 1 so that every two groups located in the vertical direction form one block B1, B2 or B3.

Since each spindle 8 is integral with an output shaft of the motor 60 fixedly secured on a frame 18' by a suitable mounting means, the bearings 20-1 and 20-2, as shown in FIGS. 1 and 2, for supporting the respective sides of the rotary shaft section 8' of the spindle are unnecessary.

Also, since a space for providing belts or chains and tension pulleys for adjusting the belt tension can be eliminated, the whole structure of the creel 1 is simplified and the size thereof is minimized.

In FIGS. 6(A) through 6(C), the same reference numerals used in FIGS. 1 and 2 are used for denoting similar elements to those shown in FIGS. 1 and 2, and an explanation thereof is omitted.

In the above embodiment, it is possible to manage a plurality of spindle groups as one block independently from other blocks. For example, if blocks B1, B2, B3 shown in FIG. 6(A) are arranged on different frames movable in the lateral direction, it is possible to vary the frame structure in accordance with a variation in the number of spindles to be used. Also, since a space between the respective frames can be optionally formed so that an operator can easily have access to the back or side of the frame, it is possible to easily carry out bobbin replacement or machine repair.

The spindle 8 according to the present invention has a shape wherein the central portion 8' has a maximum outer diameter and the side portions thereof have a reduced outer diameter.

The spindle 8 carries a bobbin on which a non-twisted yarn is wound on the side portion and rotates the same at a predetermined speed. If the spindle is out of rotational balance, vibration occurs, which causes, in the worst case, breakage of the spindle due to resonance. However, such a vibration could be suppressed to a minimum level by forming the spindle to have the above shape.

In the above embodiment, as described before, to prevent interference due to a ballooning of yarn 2 unwound from the bobbin 3-1 with adjacent bobbin 3-1 or a yarn wound on the adjacent bobbin, an anti-ballooning plate 5 is provided on the creel or a net or a bag is provided to cover the bobbin 3-1 on which a non-twisted yarn is wound. Such countermeasures, however, are inconvenient when the bobbin 3-1 on which a non-twisted yarn is wound is mounted on the spindle. Moreover, since space is required in the peripheral region of the spindle for enhancing the mounting operation, it is difficult to miniaturize the creel size.

To solve such problems, the present inventors have analyzed the generation of ballooning caused by yarn 2 unwound from the bobbin 3-1 on which the yarn is wound. The ballooning varies in accordance with various factors such as yarn weight, unwinding speed of yarn from the bobbin 3-1 or rotational speed of the outlet guide 11.

Figure 7A:
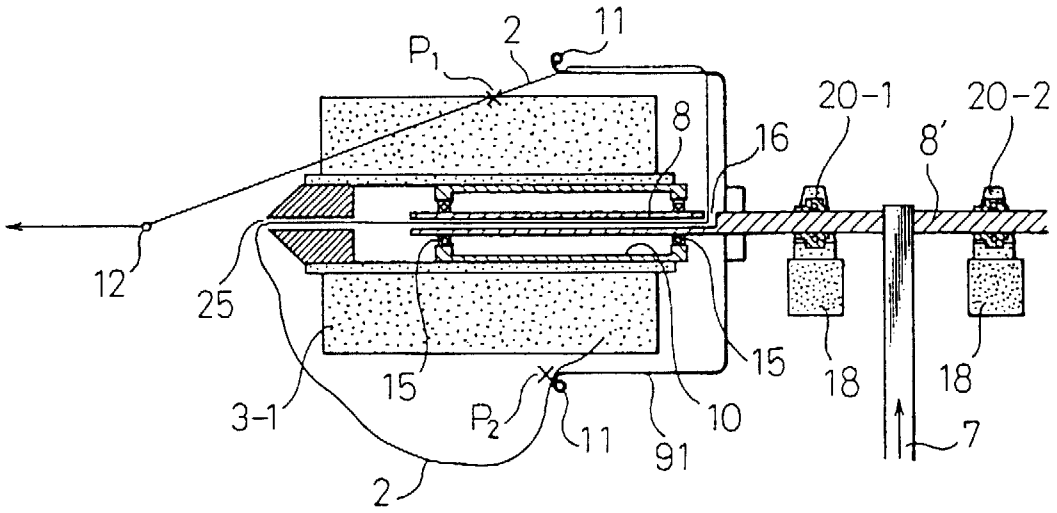
FIGS. 7(A) and 7(B) show a side view and a front view for explaining prior art problems.
Figure 7B:
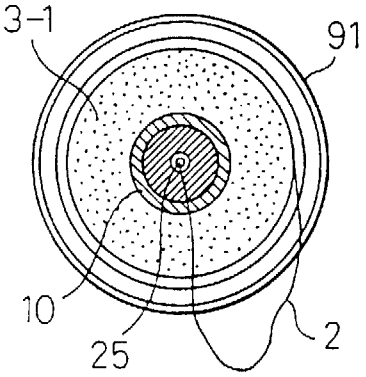

As shown in FIG. 7, it is found that, in most cases, a yarn segment between the outlet guide 11 and the outlet eyelet 12 is brought into contact with a yarn layer of the bobbin 3-1 at a point P1, or a segment of yarn 2 between the bobbin 3-1 and the eyelet 25 before being introduced into the hollow section 22 of the spindle 8 is brought into contact with the peripheral edge of a rotating twist pot 91 holding the outlet guide 11 at a point P2. Because of these contact points, the yarn is imparted with excessive friction, which may generate unevenness in twist and in the worst case may cause yarn breakage.

To solve this problem, it was conceived of to enlarge the diameter of the rotating twist pot 91. According to such a structure, however, it is necessary to provide a considerable space around the respective spindle, which causes the increase in creel size, reduction of operation efficiency and rise of manufacturing cost.

Figure 8:
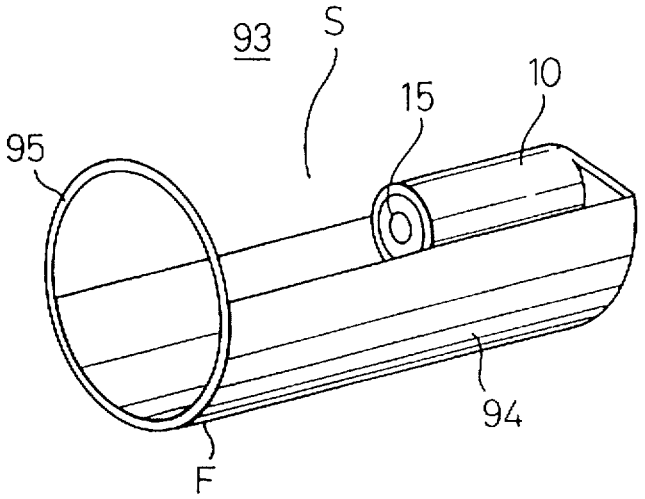
FIG. 8 is a perspective view of one embodiment of a bobbin holder used for the present invention.

The present inventors have found through study for solving these problems that a bobbin holder 93 is preferably provided in the respective spindle as shown in FIG. 8.

The bobbin holder 93 is integrally formed with the bobbin support 10 already explained with reference to FIG. 4, and provided with a yarn receiver 94 for covering the underside of the bobbin 3-1 on which a non-twisted yarn is wound and being held in the bobbin support 10, and a yarn guide 95 integrally formed with a front end F of the yarn receiver 94.

The bobbin holder 93 preferably has a space S on the upper side thereof, with a length at least two thirds of the total length of the bobbin 3-1 on which the non-twisted yarn is wound and being held in the bobbin support.

The bobbin holder 93 is coupled to the rotary shaft section of each spindle 8 having the hollow portion 22, via a bearing 15 built into the bobbin support 10, so that the bobbin 3-1 on which the non-twisted yarn is wound is maintained stationary while the rotary shaft section is rotated and the yarn receiver 94 for covering the underside of the bobbin 3-1 on which the non-twisted yarn is wound is integrally coupled with the bobbin support 10. An area of the underside of the bobbin 3-1 to be covered is not limited, but the yarn receiver 94 is preferably designed so that the bobbin 3-1 on which the non-twisted yarn is wound is at most covered in a semicircular manner.

The yarn receiver 94 is made of aluminum alloy, plastics or the like to have a desired weight sufficient for holding the bobbin on which the non-twisted yarn is wound stationarily.

The yarn guide 95 integrally formed at the front end F of the yarn receiver 94 is preferably of an annular shape and has a smooth surface.

As described before, the bobbin holder 93 of the present invention is maintained substantially in a stationary state even when each spindle 8 rotates. Also as shown in FIG. 7, a section of yarn 2 unwound from the bobbin 3-1 and reaching the eyelet 25 is prevented by the yarn receiver 94 from hanging down and a section of yarn 2 present between the outlet guide 11 and the outlet eyelet 12 is withdrawn while sliding along the peripheral edge of the yarn guide 95, whereby the yarn path is completely regulated.

In addition, in the bobbin holder 93, the space S is provided on the upper side thereof, for facilitating the insertion of the bobbin 3-1 on which the non-twisted yarn is wound, into the spindle 8, and removal of the same from the spindle 8, the space preferably having the length corresponding to about ⅔ of the total length of the bobbin.

Accordingly, due to the use of bobbin holder 93, it is unnecessary to provide an unintentional space around the respective spindle 8, whereby a pitch between adjacent spindles 8 can be reduced. This enables minimizing the total size of creel 1 and increases the operation efficiency, as well as preventing interference between yarns unwound from the adjacent bobbins and the generation of twist unevenness and yarn breakage.

Figure 9A:
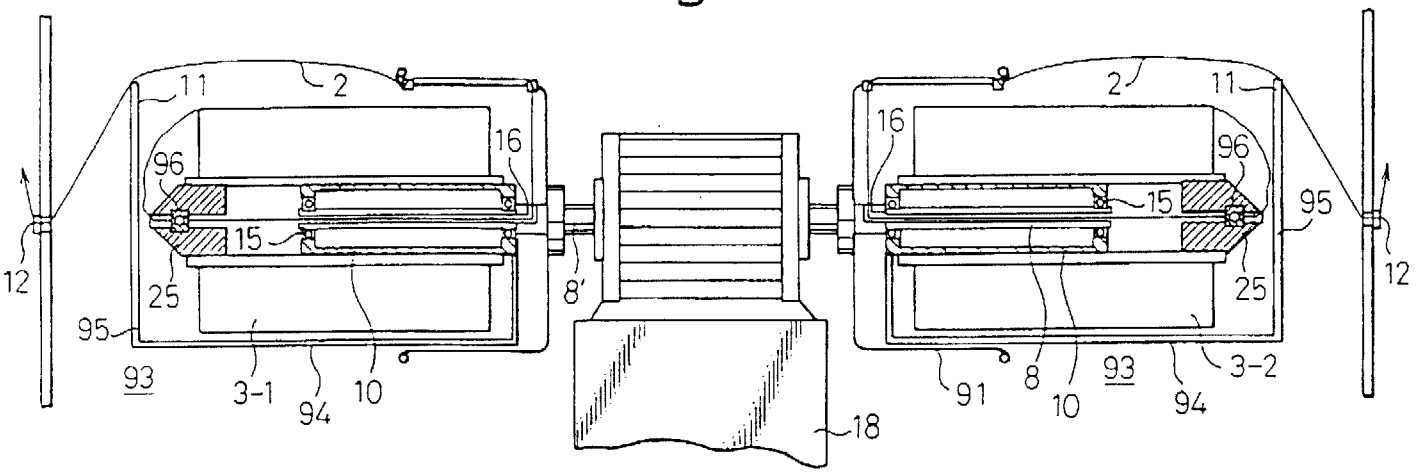
FIG. 9(A) is a side view of a creel structure using the bobbin holder shown in FIG. 8 while using a direct motor as driving means.
Figure 9B:
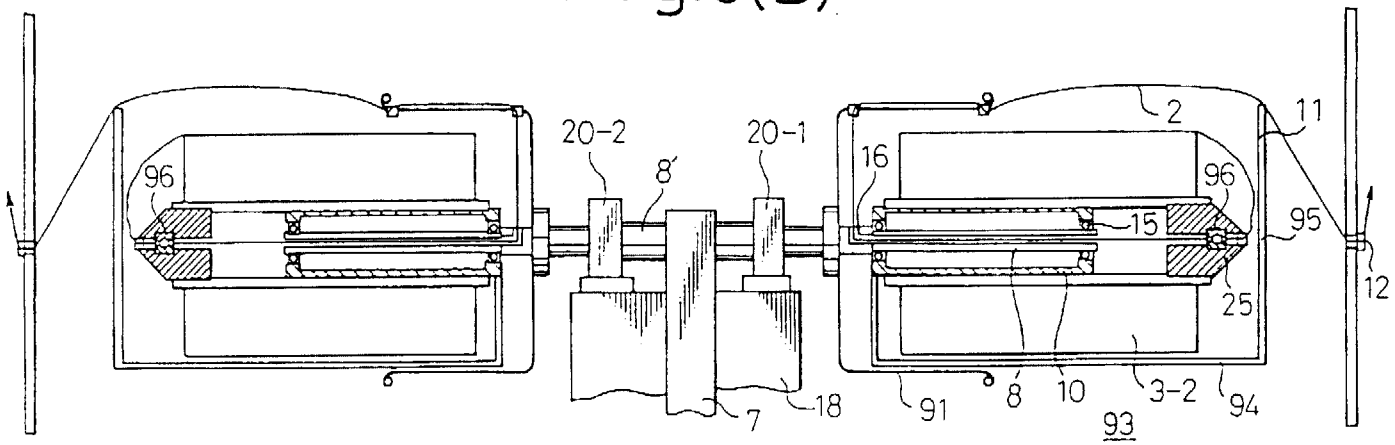
FIG. 9(B) is a similar view using a belt as driving means.

In this connection, FIG. 9(A) shows one embodiment using the above bobbin holder 93, wherein the two spindles 8 are driven by a motor. FIG. 9(B) shows another embodiment wherein the two spindles 8 are driven by a belt. In either case, the eyelet 25 provided at the front end of the respective spindle 8 may have a tensioning means 96 such as a disk tensor, ball tensor or bar tensor.

Figure 10:
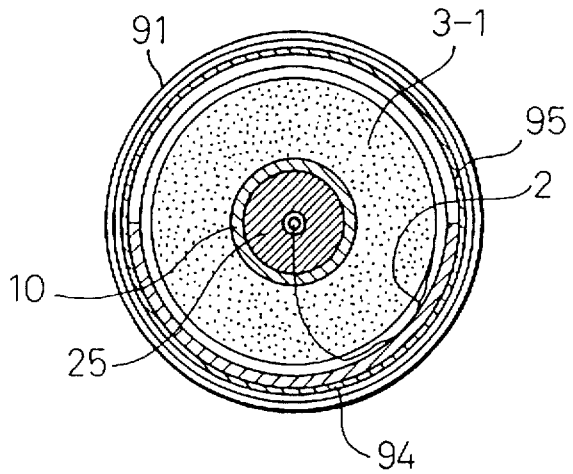
FIG. 10 is a front view of FIGS. 9(A) and 9(B).

FIG. 10 is a front view of FIGS. 9(A) and 9(B).

The bobbin support 10 and the hollow portion 22 of the spindle 8 are preferably replaceable with other ones having different shapes in accordance with the type and shape of the bobbin 3-1 or 3-2 on which the non-twisted yarn is wound. Also the width and shape of the yarn receiver 94 may be changed in accordance with the kind of yarn or the bobbin types.

The creel 1, wherein non-twisted yarns are withdrawn from bobbins and twisted, is used in combination with an apparatus for collectively processing the yarns, for example, a loom, knitting machine, netting machine or the like, or an apparatus for collectively taking up the yarns, such as a warper. Also the creel 1 can be directly coupled to an apparatus for individually taking up the yarns, such as a bobbin winder.

Examples will be explained below, wherein the creel 1 according to the present invention is used for weaving fabrics. To simplify the explanation, it is assumed that two strips of fabric are woven by a narrow width needle loom being supplied from one creel with twisting devices.

When the rotational speed of the spindle is in a lower range and the rotational speed of loom is 2,000 pick/min, warps are fed to the loom from the creel 1 at a feeding rate of about 1.5 m/min for a weft density of 33 pick/in, and at a feeding rate of about 3.0 m/min for a weft density of 16.5 pick/in. If yarns having a twisting degree of 100 turn/m are used for the production of this fabric, the rotational speed of spindle in the creel with two-for-one twisting devices according to the present invention should be 75 rpm for a yarn supply rate of 1.5 m/min and 150 rpm for a yarn supply rate of 3.0 m/min.

When an arrow width fabric is woven, the minimum rotational speed of spindle is defined as 60 rpm in the present invention. Applications of the creel according to the present invention for the production of such kinds of fabrics will be described below.

In the above-explained embodiments of the present invention, the creel having the two-for-one twisting mechanism is shown.

In the present invention, however, the embodiments, for example, in which a motor is directly mounted on a spindle or in which a spindle is provided with a spindle holder, can also be used in a creel having the single twisting mechanism.

In FIG. 1, it is assumed that spindles are divided into a plurality of groups A (uppermost row) through F (lowermost row) and controlled by motors associated with the respective groups.

(1) In FIG. 1, two groups A and B are driven by a motor 6-1, groups C and D are driven by a motor 6-2, and groups E and F are driven by a motor 6-3. If all the motors 6-1 through 6-3 are driven in the same direction and at the same rotational speed, the twisting degree of the respective yarn is identical but the twisting direction is reversed on the respective sides as seen from the creel front. In this case, if the lefthand yarns and the righthand yarns are supplied separately from each other to a loom, two kinds of fabrics, each having a different twisting direction, can be obtained.

(2) If the S-twist yarns and the Z-twist yarns are drawn into the loom, while being separated between an exit of each group in the creel and a group of tension rollers 13, two belt like fabrics in which a group of the S-twist yarns and a group of the Z-twist yarns are alternately arranged at a predetermined width, are obtained. If the fabric is a herring-bone weave woven with the same directional-twist yarns, a twill looks different depending on the direction of the twill. With this method, however, since the twisting direction can be changed for every twill, it is possible to obtain a fabric in which the twill always looks equal. The method for grouping the yarns is wellknown to a person with ordinary skill in this art and can be selected in accordance with the specification of the fabric.

(3) If the motors 6-1 and 6-3 are driven in one direction and the motor 6-2 in the opposite direction, Z-twist yarns and S-twist yarns are alternately obtained at every two groups on both side of the creel. These yarns are drawn in the loom as two yarn sheets while maintaining this arrangement, and woven. In general, when relatively hard, one-directional twist yarns are used, the resultant fabric is liable to distort. However, the above fabric according to the present invention is free from distortion because the S-twist yarns and the Z-twist yarns are mixed in a balanced manner.

(4) To use, in one fabric, warps with different thicknesses or warps with partially different twisting degrees even though the thickness is equal, it is possible to impart the respective warps with a required twisting degree by changing the rotational speed of the motors 6-1 through 6-3. If necessary, non-twisted yarns can be supplied while stopping some of the motors.

(5) If all the motors are stopped, it is possible to supply using non-twisted yarns or preliminary-twisted yarns as they are in the prior art creel.

The above description was given for a case where the creel according to the present invention is applied to a loom. However, the present invention is not limited thereto but can be suitably used for a warper. In this case, the creel usually operates in a higher rotational speed range because the feed rate is high. Examples of operation in a higher rotational speed range will be explained next based on a narrow width needle loom.

If a cord fabric having a weft density of 3 cm/pick is woven at a rate of 2,000 pick/min, the production rate is 60 m/min. If a twisting degree of 100 turn/m is imparted to the warps by a prior art twisting device, the spindle must rotate at about 6,000 rpm. However, in the case of a two-for-one twisting system, the spindle operates as low as 3,000 rpm.

If the above-mentioned apparatus for two-for-one twisting devices is a warper, it is possible to have warps having a twisting degree of 100 turn/m at a production rate of 60 m/min, and those having a twisting degree of 150 turn/m at a production rate of 40 m/min.

Since the creel according to the present invention has the above-described structure, various advantages are obtainable as follows:

1) Since the spindle rotational speed is variable over a wider range, it is possible to have an optional twisting degree not dependent on the take-up speed of the loom or warper, whereby the field of utilization is widened.

2) Since it is possible to eliminate the operation generally required with the use of twisted yarns, such as the loading of a package on the twister or rewinding of the twisted yarn from a twist bobbin, the manufacturing time, cost and productivity is improved.

3) Yarn packages in a usual form such as a straight paper tube, taper tube, or aluminum pirn can be used as they are without changing the form.

4) While a preliminarily-twisted yarn package as used in the conventional creel has a smaller weight (length) of yarn compared with the large-packaged production yarn (available from a fiber maker), the present invention has an advantage in that the large-packaged yarn is used as it is.

5) Since a spindle per se rotates while a raw yarn bobbin is stationary, it is possible to drive a number of spindles with one motor. Also since a pair of twisting devices are provided on one spindle, it is possible to simplify the structure to reduce the installation cost.

6) There is no risk of erroneous arrangement of warps when S and Z-twist yarns are mixedly used in a fabric. Also, if S and Z-twist yarns are suitably mixed in one fabric, product distortion which is liable to occur when hard twist yarns are used can be easily avoided.

7) If a plurality of driving systems are provided, it is possible to impart proper twisting degrees to yarns or warps made of different materials or having different applications.

8) Since a relatively hard twist multi-filament yarn is liable to curl due to restoration of twist, an anti-curling treatment must be carried out in the prior art. However, according to the present invention, such a treatment is unnecessary.

9) Since optionally twisted yarns are directly supplied to various textile machines according to the present invention, it is possible to adjust the twisting degree while confirming the feeling of a product while it is still on the machine, which results in higher quality products with no yarn-borne defects compared with products produced using preliminarily-twisted yarns.

10) It has been known that twisted yarn produced from a twisting machine generally have a lower strength than raw yarns. However, there is almost no reduction in strength of twisted yarns produced by the present invention.

What is claimed is:

1. A creel comprising a plurality of spindles rotatably held on a frame, each carrying bobbins on which non-twisted yarns are wound, wherein the non-twisted yarns withdrawn from the bobbins are twisted and the thus-twisted yarns are arranged in parallel to each other to form a yarn sheet, characterized in that each of the spindles has a horizontal rotary shaft section which is rotatably supported at a center portion of said rotary shaft on a creel frame via bearings, and a bobbin carrying section provided on the respective side of the rotary shaft section for carrying the bobbin on which the non-twisted yarn is wound; a suitable driving means is provided and engaged with the rotary shaft section; and a two-for-one twisting device is provided on the bobbin carrying section.

2. A creel as defined by claim 1, wherein, in a bobbin support for carrying said bobbin on which said non-twisted yarn is wound, said spindle having a rotary hollow shaft driven by said driving device and said two-for-one twisting device for drawing the non-twisted yarn into the hollow shaft, withdrawing said yarn from said hollow shaft to outside of said shaft through a hole connected to a hollow portion of said shaft and provided thereon and close to said center portion of said spindle and also close to rear end portion of said bobbin facing to said center portion of said spindle and double-twisting the yarn while the yarn reaches a yarn exit, are provided, so that the non-twisted yarn withdrawn from the bobbin is twisted while being supplied to a yarn taking up apparatus, characterized in that the spindle is a single spindle having at least two bearings in a central area thereof and hollow shaft sections on both sides; wherein said creel comprises said plurality of spindles which are arranged parallel to each other in the horizontal direction to form multi-stages in the vertical direction as seen from the lateral side of the creel; and the spindles are rotated in a predetermined direction by a single common motor via transmission means so that one of two non-twisted yarns carried on one of ends of said each spindle is twisted in an S-direction and simultaneously another non-twisted yarn carried on another end of said spindle opposite to said previous ends with respect to said motor is twisted in a Z-direction.

3. A creel as defined by claim 1, characterized in that the spindle has an eyelet for guiding the non-twisted yarn withdrawn from the bobbin into the hollow shaft sections, and a guide eyelet and an outlet guide for withdrawing the yarn from the hollow shaft section; and an outlet eyelet is provided at a position along the extension of the axis of the hollow shaft section apart from the free end of the spindle.

4. A creel as defined by claim 1, characterized in that the creel further comprises a bobbin holder consisting of a yarn receiver integrally formed with the bobbin support, for covering at least the underside of the bobbin on which the non-twisted yarn is wound and being held on the bobbin support, and a yarn guide integrally formed with a front end of the yarn receiver.

5. A creel as defined by claim 4, characterized in that a space is provided on the upper side of the bobbin holder, having a length of about ⅔ that of the bobbin on which the non-twisted yarn is wound and being held by the bobbin support.

6. A creel as defined by claim 1, characterized in that the rotational direction and speed of the spindle are variable by the driving means.

7. A creel with two-for-one twisting devices as defined by claim 1, characterized in that the driving means comprises at least two driving systems consisting of a motor and means for transmitting motor power to the central area of each spindle so that each driving system can independently set the rotational direction and speed of the spindles belonging thereto independently different from those of the other driving systems.

8. A creel with two-for-one twisting devices as defined by claim 1, characterized in that the driving means comprises individual motors, each being directly coupled to each rotary shaft section; the motors being divided into at least two driving systems so that each driving systems can vary the rotational direction and speed of the spindles thereto independently from those of the other driving systems via a control circuit provided in the respective driving system.

9. A creel with two-for-one twisting devices as defined by claim 8, characterized in that the driving means is said motor comprising a stator having a stator coil and a rotor having a rotor core made of laminated magnetic steel sheets; an output shaft of the motor being used as the central portion of the spindle shaft.

10. A creel with two-for-one twisting devices as defined by claim 1 characterized in that an apparatus to be supplied with yarns which are withdrawn from bobbins and twisted by said two-for-one twisting device is one selected from a group of apparatus for collectively processing the yarns, including a loom, knitting machine and netting machine, a warper, and a bobbin winder.

* * * * *